US005967914A

United States Patent [19]

Tanaka

[11] Patent Number: 5,967,914

[45] Date of Patent: Oct. 19, 1999

[54] BASEBALL METALLIC BAT

[75] Inventor: Kouichi Tanaka, Tokyo, Japan

[73] Assignee: Ike Corp., Tokyo, Japan

[21] Appl. No.: 08/574,330

[22] Filed: Dec. 18, 1995

[51] Int. Cl.[6] ..... A63B 59/06

[52] U.S. Cl. ..... 473/566

[58] Field of Search ..... 273/72 R, 72 A, 273/26 B

[56] References Cited

U.S. PATENT DOCUMENTS 805,132 11/1905 Gubbins ..... 273/72 R 4,177,989 12/1979 Easton et al. ..... 273/72 A 4,763,900 8/1988 Carr ..... 273/72 R

*Primary Examiner*—Mark S. Graham

*Attorney, Agent, or Firm*—Wenderoth, Ling & Ponack, L.L.P.

[57] ABSTRACT

A baseball bat which can minimize the slippage between the bat hitting surface and the ball at the instant of impact with the ball. Increased adherence between the ball and the bat hitting surface allows a spin to be easily imparted to the ball, so that the flying distance of the ball can be increased. The metallic baseball bat includes numerous longitudinal polishing streaks extending along the longitudinal axis of the metallic bat.

2 Claims, 1 Drawing Sheet

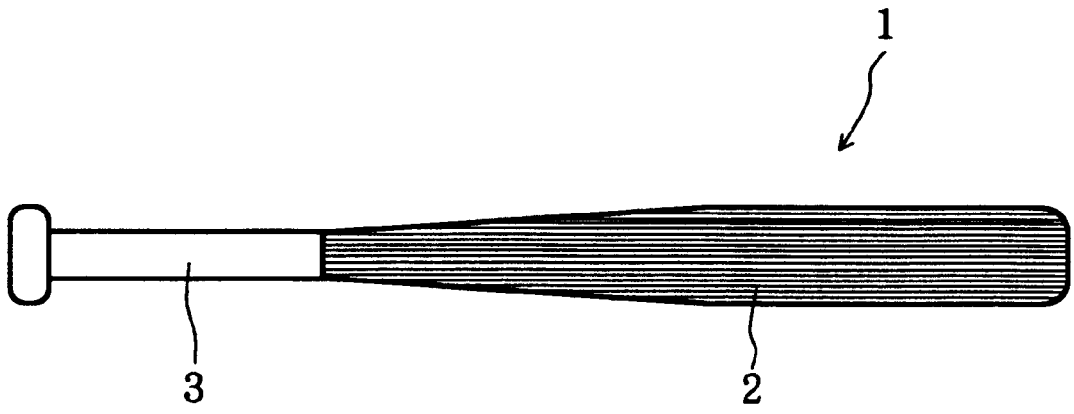
F I G. 2
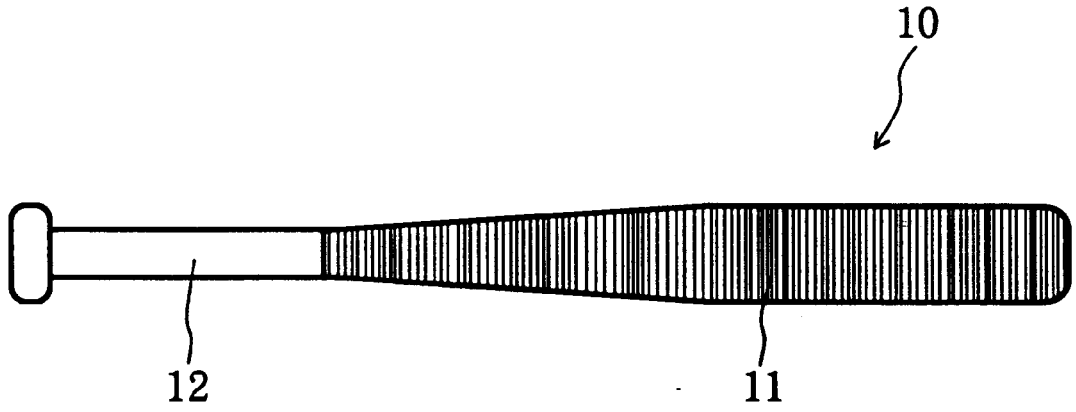

BASEBALL METALLIC BAT

BACKGROUND OF THE INVENTION

1. Field of The Invention

The present invention relates to a metallic bat for baseball, more particularly, it relates to a metallic bat provided with an improved hitting surface.

The improvement provided for a bat related to the present invention can be applied to any metallic bat such as a regulation-ball baseball metallic bat, a rubber-ball baseball metallic bat, a semi-regulation-ball baseball metallic bat, and a softball metallic bat.

2. Prior Art

With conventional metallic bats for regulation-ball baseball, rubber-ball baseball, semi-regulation-ball baseball, and softball, numerous polishing streaks 11 formed on a bat at the stage of final polishing, following the forming and working have normally been made annular about the longitudinal axis of the bat 10 as shown in FIG. 2. The reference No. 12 in FIG. 2 denotes the grip portion.

However, the annular polishing streaks 11 provided on various conventional metallic bats have presented a problem in that the annular polishing streaks 11 hit the ball vertically (longitudinally) at the instant of impact to the ball, thus, the hitting surface of the bat and the ball slightly slides each other, which lowers the adherence between the ball and the hitting surface of the bat, resulting in the factor of increasing the flying distance of the ball, i.e., the probability of the ball hit as provided with a spin being decreased, which leads to difficulty in further increasing the flying distance for the ball.

Created in consideration of such conventional situations, the present invention is directed to a metallic bat which can minimize the slippage between the bat hitting surface and the ball at the instant of impact to the ball, and increase the adherence between the ball and the bat hitting surface, thus allowing a spin to be easily imparted to the ball, so that the flying distance of the ball can be further increased, thus solving the conventional problem.

SUMMARY OF THE INVENTION

The present invention is directed to a bat which can minimize the slippage between the bat hitting surface and the ball at the instant of impact to the ball, and increase the adherence between the ball and the bat hitting surface, thus allowing a spin to be easily imparted to the ball, so that the flying distance of the ball can be increased.

The metallic baseball bat of the present invention features numerous longitudinal polishing streaks provided along the longitudinal axis of the metallic bat, as shown in FIG. 1.

BRIEF DESCRIPTION OF THE DRAWINGS

FIG. 1 is a front elevation of a metallic bat of the preferred embodiment of the present invention; and FIG. 2 is a front elevation of a conventional metallic bat.

DETAILED DESCRIPTION OF THE INVENTION

The metallic baseball bat is provided with numerous longitudinal polishing streaks along the longitudinal axis of the metallic bat.

The metallic baseball bat is colored after being provided with polishing streaks.

The metallic baseball bat is that with which the metallic bat is any one of the regulation-ball baseball metallic bat, rubber-ball baseball metallic bat, semi-regulation-ball baseball metallic bat, and softball metallic bat.

The function of each invention configured as stated above will be described here.

With the metallic baseball bats numerous longitudinal polishing streaks are provided along the longitudinal axis of the metallic bat 1, thus, the polishing streaks hit against the ball horizontally (transversely) at the instant of impact to the ball, which can minimize the slippage between the bat hitting surface and the ball at the instant of impact to the ball, and thus increase the adherence between the ball and the bat hitting surface, thus allowing a spin to be easily imparted to the ball hit, so that the flying distance for the ball can be further increased.

By referring to the attached drawings, the preferred embodiment of the bat of the present invention will be described here in detail.

FIG. 1 shows a front view of a bat 1 of the preferred embodiment of the present invention.

As shown in FIG. 1, with the bat 1, numerous longitudinal polishing streaks 2 are provided in the exterior surface of the barrel portion of the bat 1 along the longitudinal axis of the bat 1 at the stage prior to the final polishing step to make a finished product following the forming and working of a metallic bat. The reference No. 3 in FIG. 1 denotes the grip portion.

The polishing streaks 2 can be provided by various means on either manual or electrical-power operation using a variety of polishing materials such as sandpaper.

The longitudinal polishing streaks 2 along the longitudinal axis of the bat 1 can be provided for any metallic bat of the regulation-ball baseball metallic bat, rubber-ball baseball metallic bat, semi-regulation-ball baseball metallic bat, and softball metallic bat.

The bat 1 of the present invention, which is provided with numerous longitudinal polishing streaks 2 along the longitudinal axis of the bat 1, may be colored after the polishing streaks 2 have been provided.

The bat 1 of the present invention is provided with numerous longitudinal polishing streaks 2 along the longitudinal axis of the bat 1, thus the polishing streaks 2 hit against the ball horizontally (transversely) at the instant of impact to the ball.

Therefore, when compared to conventional bats with annular polishing streaks 11, the bat 1 of the present invention can minimize the slippage between the bat hitting surface and the ball at the instant of impact to the ball, and increase the adherence between the ball and the bat hitting surface, thus allowing a spin to be easily imparted to the ball hit, so that the flying distance for the ball can be further increased.

The present invention is not limited to the above-stated preferred embodiment, but permits various variants to be embodied within the scope of the claims.

The present invention described above in detail provides:

The present invention described above in detail provides a metallic bat for baseball which can further increase the flying distance for a ball hit with the bat.

What is claimed is:

1. A metallic ball bat comprising:

a metal handle section; and a metal barrel section extending from said handle section, wherein a plurality of longitudinal polishing grooves are formed in an exterior surface of said metal barrel section.

2. The metallic ball bat as claimed in claim 1, further comprising a colorant provided on said exterior surface of said barrel section having said grooves.

* * * * *